United States Patent [19]

Leopoldi et al.

[11] Patent Number: 4,903,860

[45] Date of Patent: Feb. 27, 1990

[54] NITROGLYCERINE PILL-DISPENSER WORN ABOUT NECK

[75] Inventors: Norbert Leopoldi, Chicago; William Heinrich, McHenry, both of Ill.

[73] Assignee: The Cloverline, Inc., Chicago, Ill.

[21] Appl. No.: 293,802

[22] Filed: Jan. 5, 1989

[51] Int. Cl.[4] ..... A47F 1/04

[52] U.S. Cl. ..... 221/4; 221/185; 221/306; 222/522; 222/175

[58] Field of Search ..... 222/78, 175, 192, 522; 221/185, 288, 306, 287, 24, 4; 206/535–537, 534, 534.2; 24/616, 617, 598

[56] References Cited

U.S. PATENT DOCUMENTS

| | | | |
|---|---|---|---|
| 1,446,894 | 2/1923 | Foley | 222/522 |
| 2,353,629 | 7/1944 | Apfelbaum | 206/536 |
| 2,775,369 | 12/1956 | Waite | 222/522 |
| 3,305,145 | 2/1967 | Tebbutt | 222/522 |
| 3,695,487 | 10/1972 | Slayton et al. | 222/42 |
| 3,762,539 | 10/1973 | Kerr | 206/534 |
| 4,170,962 | 10/1979 | Limbaugh | 24/598 |

FOREIGN PATENT DOCUMENTS

| | | | |
|---|---|---|---|
| 1092506 | 4/1955 | France | 221/306 |

*Primary Examiner*—H. Grant Skaggs
*Attorney, Agent, or Firm*—Milton Gerstein

[57] ABSTRACT

A pill-dispenser to be worn as a neck-chain. The dispenser includes a storage tube having an upper dispensing outlet selectively closed off or opened via a sliding sleeve retained in place over the dispensing outlet by o-rings. The storage tube is coupled at its upper end to a chain whereby it is suspended in pendant-like fashion for aesthetic appearance.

1 Claim, 2 Drawing Sheets

FIG. 6
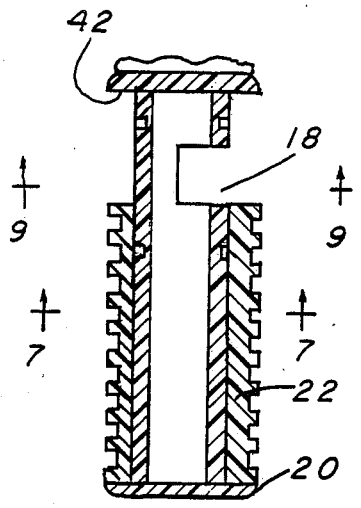
FIG. 5
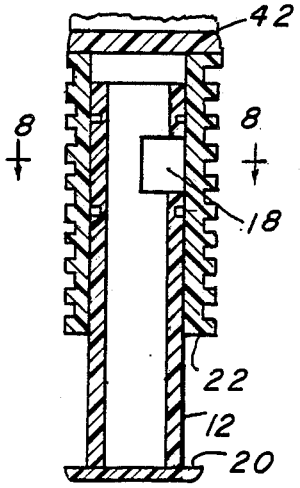
FIG. 7
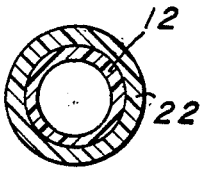
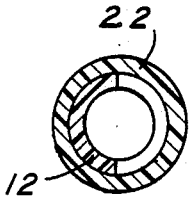
FIG. 9
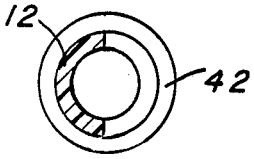
FIG. 8

NITROGLYCERINE PILL-DISPENSER WORN ABOUT NECK

BACKGROUND OF THE INVENTION

The present invention is directed to a dispenser for storing and facily dispensing nitroglycerine pills. It is known that nitroglycerine is a vasodilator, providing fast and effective to certain persons suffering from heart disease. The present invention provides a dispenser worn about the neck to allow fast and easy access to nitroglycerine tablets when a person requires same.

SUMMARY OF THE INVENTION

It is the primary objective of the present invention to provide a dispenser for storing and dispensing nitroglycerine pills in a fast and easy manner.

It is another objective of the present invention to provide such a dispenser that is worn about the neck, serving as an ornamental necklace as well.

Toward these and other ends, the nitroglycerine dispenser of the invention is provided with a pill-storage cylinder or tube, having a lower closed end and an upper, pill-dispensing mouth. A slidable cover-tubing telescopingly surrounds a major portion of the length of the pill-storage tube, which cover-tubing is movable downwardly to expose the upper, open mouth or end of the pill-storage tube, for the dispensing of nitroglycerine pills thereby via the open mouth. The cover-tubing closes off the upper open mouth when slid upwardly. The cover-tubing is retained in its upper, closing-off state by frictional contact between the interior circumferential surface thereof and the exterior surfaces of a pair of O-rings sandwiching therebetween the open mouth of the pill-storage tube. An ornamental ring or loop is fixedly connected or formed integrally with the upper distal end of the pill-storage tube, by which the product may be suspended via a chain about the neck, to provide a readily accessible pill dispenser doubling as an ornamental necklace. The O-rings also provide an interior seal to protect the pills from ambient conditions.

BRIEF DESCRIPTION OF THE DRAWING

The invention will be more readily understood with reference to the accompanying drawing, wherein:

FIG. 5 is a cross-sectional view taken along line 5—5 of FIG. 4;

FIG. 6 is a cross-sectional view taken along line 6—6 of FIG. 4;

FIG. 7 is a cross-sectional view taken along line 7—7 of FIG. 5;

FIG. 8 is a cross-sectional view taken along line 8—8 of FIG. 6; and

FIG. 9 is a cross-sectional view taken along line 9—9 of FIG. 6.

DETAILED DESCRIPTION OF THE INVENTION

Figure 1:
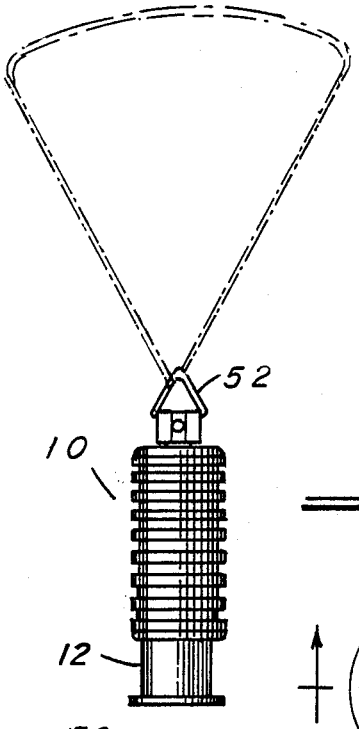
FIG. 1 is a front view showing the nitroglycerine pill dispenser of the invention.
Figure 2:
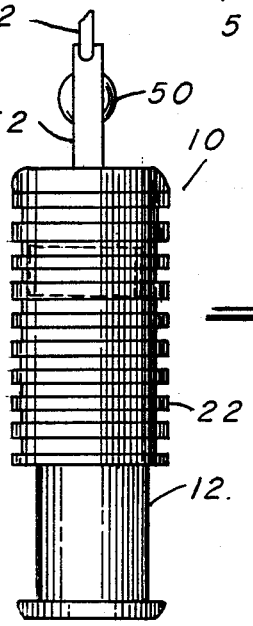
FIG. 2 is a side elevational view thereof.
Figure 4:
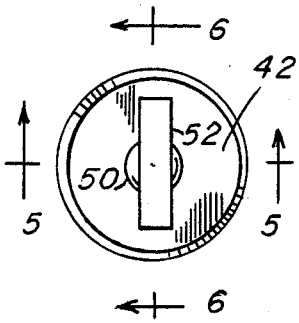
FIG. 4 is a top view thereof.
Figure 3:
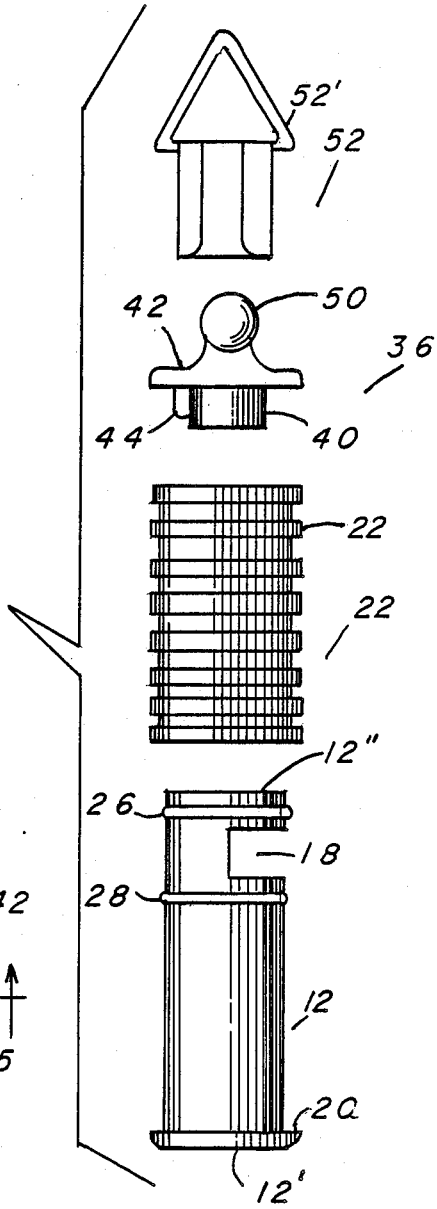
FIG. 3 is an assembly view thereof.

Referring now to the drawings in greater detail, the pill-dispenser is indicated generally by reference numeral 10. The pill-dispenser 10 includes a main storage portion 12 of generally tubular construction having a closed lower end 12' and an open upper end 12''. The nitroglycerine pills are stored in this tubular storage chamber 12. The chamber 12 also defines a lower enlarged, peripheral beaded portion 20 which serves as a limit stop and retaining lip for a slidable closure member 22, described below. The tubular member 12 defines an upper outlet mouth portion 18 through which the pills are actually dispensed by upturning the chamber 12 so that a pills will fall out by gravity. The mouth portion 18 preferably extends for about 180 degrees about the circumference, as seen in FIGS. 8 and 9. Sandwiching the mouth therebetween are a pair of flexible, rubber, o-rings 26, 28 which are used for retaining the closure member 22 in its closing-off state shown in FIG. 2, by frictionally retaining the closure member in its uppermost position, where it closes off the outlet mouth portion 18, as shown in FIGS. 2 and 5. Each o-ring fits in a circular groove or channel formed in the outer circumferential surface of the tubular chamber 12, to allow not only for the retention of the closure member in its upper, closing-off state, but also so that such closure member 22 may be easily slid down downwardly into its open state with relative ease and facility, which open state is shown in FIG. 6, where the outlet mouth portion 18 is exposed to the ambient surroundings. The closure member 22 is also tubular in construction, and has a diameter slightly larger than that of the tubular storage chamber 12, but less than that of the beaded rim 20, so that the downward-most, open-state position of the closure member 22 is when it lower end abut against the beaded rim 20, as shown in FIG. 6. The length, therefore, of the closure member is less than the distance from the beaded rim 20 to the lower edge of the outlet mouth portion 18, though it may be larger, as long as there is some ambient exposure of the outlet mouth portion 18 by which the pills may be dispensed. The placement of the closure member into its downward, open position is achieved by merely overcoming the frictional contact between its interior surfaces and the oOrings 26, 28. The outer, closure member 22 may also be preferably formed with a knurled outer surface 22' to provide better and surer finger-gripping. The upper open end 12'' of the tubular storage chamber 12 is closed off by a socket-arrangement 36 which has a lower telescopingly-received cylindrical member 40 which is received in the upper end 12'', and a larger-diameter flange 42 of larger diameter than the end 12'', for closing the end off. The member 40 and flange 42 are fixedly secured to the tubular storage chamber 12 after assembly, so as to become one integral unit therewith, and also serving to prevent the outer closure member 22 from being slid off the storage chamber 12, thereby acting as a limit stop therefor. The arrangement 36 also has an index lug 44 which cooperates with a notch or groove in the inner upper interior surface of the tubular storage chamber 12 so as to orient the arrangement 36 properly with respect to the upper end 12'', so that an arrow on the upper surface face of the flange 42 will point in the direction of the outlet mouth opening. That is, the arrow will in the opposite direction as the lug 44 when viewing FIG. 3. Removable securable to the arrangement 36, via a socket or sphere 50 thereof, is a metal hanger ring 52 defining a lower receiving chamber 54 for the pop-fit of the sphere 50 therein. The hanger has a triangular bracket 52' by which a chain or the like may be passed through for suspending the pill dispenser about the neck of the person for easy and ready access in case of need. The closure member 22 and storage chamber 12 is preferably made of thermoplastic resin, though any suitable material may be employed.

While a specific embodiment of the invention has been shown and described, it is to be understood that numerous changes and modifications may be made therein without departing from the scope, spirit and intent of the invention as set forth in the appended claims.

What we claim is:

1. A dispenser for pills, such as nitroglycerine, comprising:

a pill-storage container in which may be stored pills, said pill-storage container comprising a closed lower end portion and an open upper end portion, said open upper end portion having a dispensing outlet by which the stored pills may be dispensed;

slidable cover means telescopingly and slidingly mounted about a portion of the length of said pill-storage container, said cover means closing off said dispensing outlet of said open upper end portion of said pill-storage container when positioned thereabout, and allowing access thereto when slid away therefrom to allow for dispensing of the pills;

means for releasably retaining said cover means about said dispensing outlet in said closing-off state thereof, so that said cover means may be easily slid away from said dispensing outlet when dispensing of a pill is required;

said means for releasably retaining comprising a pair of O-rings mounted about said upper end portion, said dispensing outlet being positioned between said pair of 0-rings, said pair of O-rings also sealing the interior of said pill-storage container from ambient conditions;

ring means connected to said upper end portion of said pill-storage container for connection to a chain, whereby said pill storage container may be hung from the neck of a person as a necklace;

means for securement about a neck of a person, said means for securement passing through said ring means, so as to form a necklace with said pill-storage container serving also as an ornament, whereby ready and easy access to the pills stored in said pill-storage container is provided;

said cover means comprising a hollow sleeve defining open lower and upper ends; said sleeve having a length less than the length of said pill-storage container such that, when said sleeve is in its downwardmost position, said dispensing outlet is exposed for dispensing pills;

said lower end portion of said pill-storage container comprising an enlarged, peripheral flange member having a diametric expanse greater than that of said sleeve, whereby removal of said cover means from said pill-storage container is prevented when said sleeve is lowered for the dispensing of pills;

said closure cover means comprises an upper visible surface comprising orientation means for indicating the location of said dispensing outlet, in order to expedite removal of a pill;

said upper end portion comprising a pair of circular recesses in which are mounted said pair of O-rings, one said O-ring in one said circular recess.

* * * * *